US006505621B2

(12) United States Patent
Gabelmann

(10) Patent No.: US 6,505,621 B2
(45) Date of Patent: Jan. 14, 2003

(54) GAS STOVE FOR COOKING FOOD WITH AT LEAST ONE GAS BURNER AND A GAS COOKTOP FOR COOKING FOOD WITH AT LEAST ONE GAS BURNER

(75) Inventor: Torsten Gabelmann, Wiesbaden (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/952,314

(22) Filed: Sep. 14, 2001

(65) Prior Publication Data

US 2002/0096169 A1 Jul. 25, 2002

(30) Foreign Application Priority Data

Sep. 18, 2000 (DE) ..... 200 16 145 U

(51) Int. Cl.[7] ..... F24C 3/00
(52) U.S. Cl. ..... 126/39 R; 126/39 M; 126/214 R
(58) Field of Search ..... 126/39 J, 39 M, 126/39 E, 214 D, 211, 214 R, 39 R; 219/452.11, 460.1, 465.1

(56) References Cited

U.S. PATENT DOCUMENTS

| | | | | | |
|---|---|---|---|---|---|
| 3,490,123 | A | * | 1/1970 | Clark | 126/39 M |
| 5,653,219 | A | * | 8/1997 | Taplan et al. | 126/39 R |
| 6,032,662 | A | | 3/2000 | Taplan et al. | |
| 6,098,613 | A | | 8/2000 | Weirsma | |
| 6,173,708 | B1 | | 1/2001 | Arntz et al. | |

FOREIGN PATENT DOCUMENTS

| | | | | |
|---|---|---|---|---|
| DE | 3427453 | * | 2/1986 | 126/39 M |
| FR | 2626965 | * | 8/1989 | 129/39 M |

* cited by examiner

*Primary Examiner*—James C. Yeung
(74) *Attorney, Agent, or Firm*—Nils H. Ljungman & Associates

(57) ABSTRACT

There is now provided a stove for cooking food or a cooktop for cooking food with at least one gas burner which is located in a cutout in a plate-shaped cover with a coating applied to the upper side of the cover plate.

20 Claims, 6 Drawing Sheets

GAS STOVE FOR COOKING FOOD WITH AT LEAST ONE GAS BURNER AND A GAS COOKTOP FOR COOKING FOOD WITH AT LEAST ONE GAS BURNER

BACKGROUND OF THE INVENTION

1. Field of the Invention

This invention relates to a gas stove for cooking food with at least one gas burner and a gas cooktop for cooking food with at least one gas burner.

2. Background Information

A conventional gas cooking appliance will incorporate a cooktop which is generally formed of a glass or glass ceramic. The cooktop is provided with an opening for receiving a gas operated burner. More specifically, the gas burner projects through the cooktop and is typically rigidly secured to a chassis of the appliance and either fixedly or loosely secured to the cooktop. Whether a rigid or a loose connection is present, some type of sealing arrangement is often provided between the cooktop and the gas burner in order to seal the opening so as to enhance the cleanability of the overall appliance.

Other known gas appliances incorporate ceramic based cooktops, e.g., ceramic and glass-ceramic cooktops. Due to material characteristic limitations, the interior panel of such a ceramic based cooktop must be free to flex during use of the appliance. For at least this reason, either a loose connection or no connection at all is generally provided between a gas burner and a ceramic based cooktop, while a rigid connection is utilized between the gas burner and the appliance chassis. With such an arrangement, since the gas burner must still project through an opening in the cooktop, it is extremely difficult to provide an extremely effective seal around the burner unit.

Gas appliances, and in particular cooktops having modular, plug-in cooking units are known and commercially available. Typically, these cooktops have two or more compartments into which modular cooking cartridges are inserted. For example, one cooktop may include a surface burner cartridge disposed in one compartment and a grilling cartridge disposed in another. compartment.

For ease of manufacturing, connections for the operation of the modular cooking cartridges are permanently installed in the gas appliance. The connections are disposed in the gas appliances so as to facilitate easy connection to a modular cooking unit and typically include identical gas outlets for each compartment for providing gas to the modular cooking cartridges. Thus, the manufacturer can manufacture standardized modular cooking cartridges and can more economically provide a wider variety of gas appliances as demanded by consumers.

Also, typically, the.connections in the gas appliance include a gas orifice that is standardized to provide a gas flow rate suitable for surface burner units. Some modular cooking cartridges, such as grilling cartridges, however, require a lower gas flow rate than surface burner cartridges, and will not function properly at the higher gas flow rates. Thus, gas flow rate incompatibility presents a problem when installing, for example, a grilling cartridge into a standardized modular cooktop.

In conventional modular cooktops, this incompatibility problem is solved by removing the standard orifice and changing it to an orifice that matches the gas flow rate requirement of the cooking cartridge to be installed. This is inconvenient and undesirably wasteful in terms of labor and material.

U.S. Pat. No. 6,032,662 issued to Taplan et al. on Mar. 7, 2000, relates to a cooktop apparatus wherein a cooktop panel is seated in a frame and is made of glass ceramic, glass or ceramic. The cooktop panel has a cutout for accommodating a gas burner in the cooktop panel. A component assembly holds the gas burner in the cooktop panel and the component assembly includes a collar annularly overlapping a portion of the panel in the region of the cutout. The collar has an inner region defining an edge which, in turn, defines a first abutment for engaging the gas burner. A resilient metal element is attached to the gas burner and extends outwardly from the gas burner to engage the panel on the lower side thereof. The lower side of the panel defines a second abutment against which-the resilient metal element applies a force to hold the gas burner on the panel via the collar and the resilient metal element. A seal is sandwiched and clamped between the collar and the panel thereby preventing any spillage from reaching the frame through the cutout.

U.S. Pat. No. 6,173,708 issued to Arntz et al. on Jan. 16, 2001, relates to a gas burner mounting assembly which includes a gas injector having a main body portion positioned between a chassis member of a gas cooking appliance and a ceramic based cooktop of the appliance. The gas injector also includes an upper body portion which extends through an aperture formed in the cooktop. A burner retention bracket is interposed between the main body portion of the gas injector and an underside of the cooktop. A resilient support preferably acts between the gas injector and the cooktop, although no rigid attachment is made between these elements. The gas injector is mechanically, fixedly secured to the cooktop in order to allow the gas injector to flex with the cooktop.

Gas cooktops, which are also called hob tops, typically have a cover that is made of thermally or chemically tempered soda lime glass. This glass has the characteristic that a maximum temperature limit must be observed if it is to retain its temper and thus retain a significantly better resistance to mechanical and thermal loads, and is therefore not destroyed during the operation of the cooktop.

In practice, however, it has been determined that the maximum allowable temperature is exceeded in certain cooking situations. Tests on commercial units have thereby shown that the allowable maximum temperature that may be applied to the glass for a short period of time was exceeded by up to 20%.

This overheating can be prevented by selecting the diameter of the borings in the glass covers that hold the gas burners as large as possible, and by placing a sheet metal pan underneath them. The edge of the boring is also enclosed by a collar.

However, this principle can only be used up to a certain diameter of the boring, and in unusual cooking situations, e.g. if a pot or pan boils dry or if a very large pot is placed over two burners, it cannot prevent the maximum allowable temperature from being exceeded, if only for a short time.

The problems are similar or analogous if the cover of the gas cooktop is made of another temperature-limited material such as glass ceramic or plastic.

OBJECT OF THE INVENTION

The object of the invention is to realize a cooktop of the type described above so that the maximum temperatures at which the respective cover material can be used are not exceeded.

It is also an object of the invention to realize a gas stove having at least one burner or a gas cooktop having at least one burner in which the plate adjacent the corresponding cutout portion is protected so as to retain its strength and resiliency.

SUMMARY OF THE INVENTION

The invention teaches that this object can be accomplished by a stove for cooking food, said stove comprising: a stove body; said stove body comprising a base and a top; said top comprising a cooktop; said cooktop comprising a plate having a top and a bottom; said plate comprising a cutout portion; at least one heating arrangement to cook food; said at least one heating arrangement being disposed at said cutout portion of said plate; said at least one heating arrangement comprising a device to receive a bottom of a cooking utensil to cook food; a layer; said layer being disposed on said top of said plate and being disposed substantially adjacent said cutout portion; at least a portion of said layer being disposed at each said at least one heating arrangement and being configured to reflect heat produced from its corresponding heating arrangement and a cooking utensil disposed on its corresponding device to receive a bottom of a cooking utensil; said layer comprising at least a portion being disposed, configured, and dimensioned to minimize overheating of said plate at least under said layer by being configured to reflect heat emitted from at least one of: said at least one heating arrangement and an overheated cooking utensil; said at least one heating arrangement comprising a gas burner; said cutout portion being disposed about said gas burner; at least one conduit to supply gas to said gas burner to heat a cooking utensil to cook food; and at least one valve to control the supply of gas to said gas burner of said stove.

The invention also teaches a stove, wherein: said layer comprises a layer at least partially covering said plate.

The invention further teaches a stove, wherein: said layer comprises a layer substantially fully covering said top of said plate.

The invention still further teaches a stove, wherein: said layer comprises a first layer disposed on said top of said plate; and further comprising: a second layer disposed between said first layer and said plate; said second layer comprising a non-glare material to minimize reflection of light.

The invention also broadly teaches a stove for cooking food, said stove comprising: a stove body; said stove body comprising a base and a top; said top comprising a cooktop; said cooktop comprising a plate having a top and a bottom; said plate comprising a glass; said plate comprising a cutout portion; at least one heating arrangement to cook food; said at least one heating arrangement being disposed at said cutout portion of said plate; said at least one heating arrangement comprising a device to receive a bottom of a cooking utensil to cook food; a layer; said layer being disposed on said top of said plate and being disposed substantially adjacent said cutout portion; at least a portion of said layer being disposed at each said at least one heating arrangement and being configured to reflect heat produced from its corresponding heating arrangement and a cooking utensil disposed on its corresponding device to receive a bottom of a cooking utensil; said layer comprising at least a portion being disposed, configured, and dimensioned to minimize overheating of said plate at least under said layer by being configured to reflect heat emitted from at least one of: said at least one heating arrangement and an overheated cooking utensil; said at least one heating arrangement comprising a gas burner; said cutout portion being disposed about said gas burner; at least one conduit to supply gas to said gas burner to heat a cooking utensil to cook food; and at least one valve to control the supply of gas to said gas burner of said stove.

Another feature of the invention resides broadly in a stove, wherein: said layer comprises a layer at least partially covering said plate at least immediately about said cutout.

Yet another feature of the invention resides broadly in a stove, wherein: said layer comprises a first layer disposed on said top of said plate; and further comprising: a second layer disposed between said first layer and said plate; said second layer comprising a non-glare material to minimize reflection of light.

Still another feature of the invention resides broadly in a stove, wherein: said layer is disposed in a predetermined pattern; said pattern having at least one portion that is colored.

A further feature of the invention resides broadly in a stove, wherein: said plate comprises at least one of: a thermally tempered soda lime glass plate, a chemically tempered soda lime glass plate, a borosilicate glass plate, a non-transparent plastic plate, and a glass ceramic plate.

Another feature of the invention resides broadly in a stove, wherein: said layer comprises a layer substantially fully covering said top of said plate.

The invention further teaches a cooktop for cooking food, said cooktop comprising: a plate having a top and a bottom; at least one heating arrangement; said plate comprising a cutout portion; a layer; said layer being disposed on said top of said plate and being disposed about said cutout portion; at least one heating arrangement to cook food; said at least one heating arrangement being disposed at said cutout portion of said plate; said at least one heating arrangement comprising a device to receive a bottom of a cooking utensil to cook food; said layer being disposed on said top of said plate and being disposed about said cutout portion; at least a portion of said layer being disposed at each said at least one heating arrangement and being configured to reflect heat produced from its corresponding heating arrangement and a cooking utensil disposed on its corresponding device to receive a bottom of a cooking utensil; said layer comprising at least a portion being disposed, configured, and dimensioned to minimize overheating of said plate at least under said layer by being configured to reflect heat emitted from at least one of: said at least one heating arrangement and an overheated cooking utensil; said at least one heating arrangement comprising a gas burner; and said cutout portion being disposed about said gas burner of said cooktop.

Still another feature of the invention resides broadly in a cooktop, wherein: said plate comprises at least one of: a thermally tempered soda lime glass plate, a chemically tempered soda lime glass plate, a borosilicate glass plate, a non-transparent plastic plate, and a glass ceramic plate.

A further feature of the invention resides broadly in a cooktop, wherein: said layer comprises a layer at least partially covering said plate at least adjacent said cutout.

Another feature of the invention resides broadly in a cooktop, wherein: said layer comprises a layer substantially fully covering said top of said plate.

Yet another feature of the invention resides broadly in a cooktop, wherein: said layer comprises a first layer disposed on said top of said plate; and further comprising: a second layer adjacent said first layer; said second layer comprising a non-glare material to minimize.

Still another feature of the invention resides broadly in a cooktop, wherein: said second layer comprises a material to minimize diffusion of incident light.

A further feature of the invention resides broadly in a cooktop, wherein: said first layer is disposed in a predetermined pattern; said pattern having at least one portion that is pigmented.

Another feature of the invention resides broadly in a cooktop comprising a hob top.

On a cooktop that has at least one atmospheric gas burner that is located in a boring of a plate-shaped cover that is made of temperature-limited material, the invention teaches that a heat-reflecting surface is applied only to the upper side of the cover plate.

As a result of the realization of the cooktop as taught by the invention, it is possible to reduce and/or to limit the temperatures that occur in the cooktop cover plate under extraordinary cooking situations so that the maximum allowable short-term temperature is not exceeded, as a result of which unsafe excess temperatures are prevented. The measures claimed by the invention therefore contribute to increased operating safety. The diameter of the borings can also be kept small, and the burners used can be relatively flat, i.e. relatively low, because the manufacturer's design freedom is increased.

In one realization of the invention, the cooktop is realized so that the cover plate is formed by a thermally or chemically tempered soda lime glass plate. The glass cover plate is typically printed without color on the reverse side, so that it is not transparent, and is subsequen tly thermally tempered. A decorative printing can also be applied.

The measures taught by the invention make it possible not to exceed the short-term allowable maximum temperature for this glass, and thus for the glass plate to retain over its guaranteed life a sufficient temper which is typically approximately 80% of the original temper, because the maximum allowable temperatures reduce the temper by approximately 20%.

The situation is similar if, as taught by one alternative configuration of the invention, the cover plate is formed by a printed and optionally decorated plate made of borosilicate glass.

The cover that forms the cooking surface can theoretically also be made of plastic. The temperature at which this material can be used is also limited.

The cover plate can also be formed by a glass ceramic plate. In this case, a particularly major concern is the thermal protection of the temperature-sensitive electric components that are typically located underneath the glass ceramic plate.

In one realization of the invention, the coating is colored. The coating can be dark, for example, thereby guaranteeing the aesthetically necessary non-transparency of the cover plate, so that the interior of the cooktop is concealed. The cover can also be given a color that coordinates with the design of the respective kitchen, in which case a decorative coating can also be advantageously applied.

In an additional configuration of the invention, the entire surface of the glass plate can theoretically be coated. The coating can be manufactured and applied easily.

To achieve the effects claimed by the invention, however, it is sufficient if appropriate templates are used during the coating process to coat only the areas of the cover plate that are subject to severe thermal-stresses.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Additional characteristics and advantages of the invention are described below, with reference to the exemplary embodiments of the invention that are illustrated in the accompanying drawings.

DESCRIPTION OF THE PREFERRED EMBODIMENTS

Figure 1:
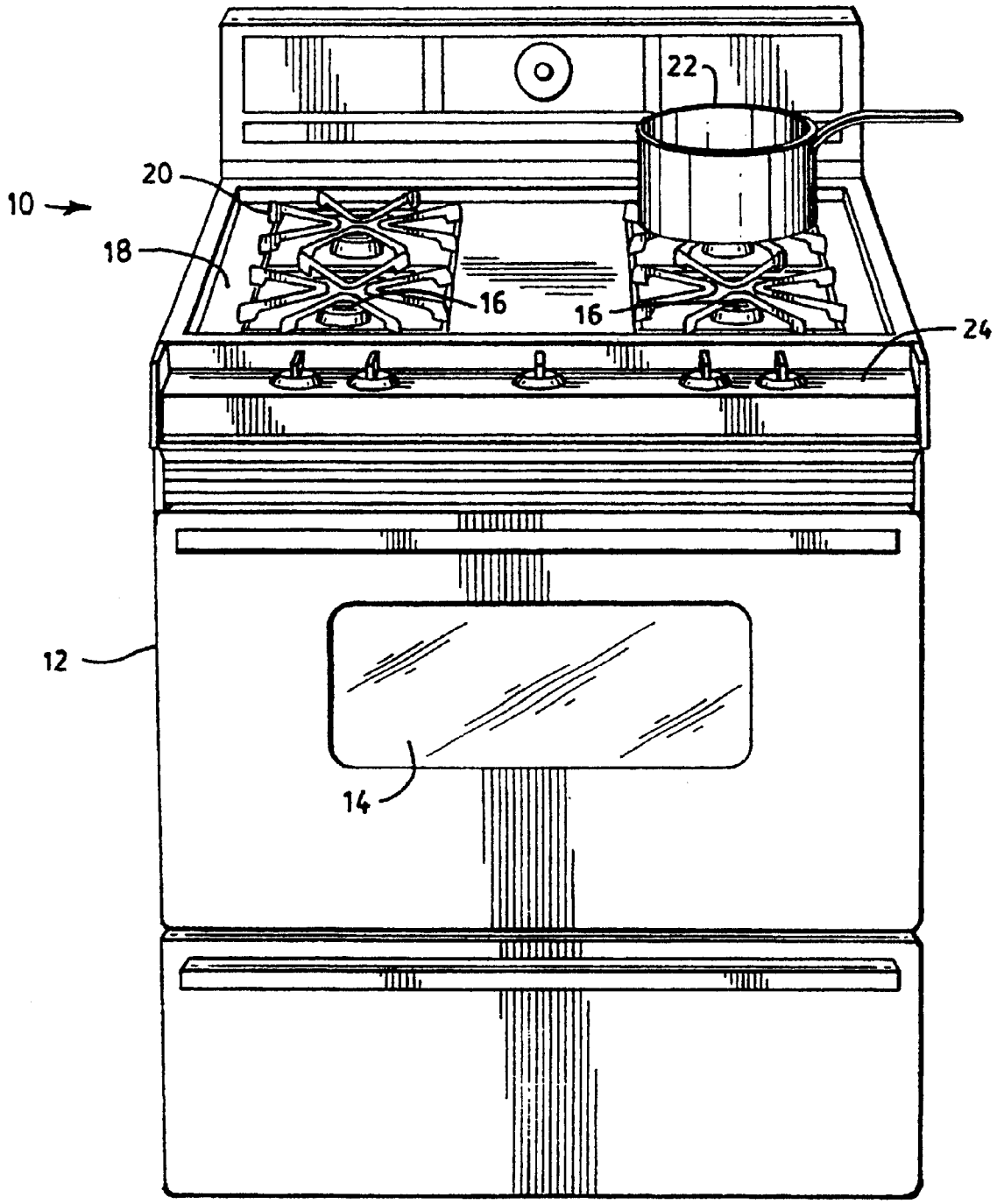
FIG. 1 is a perspective front view of a gas cooking appliance.

Referring to FIG. 1, a free standing gas cooking appliance 10 or range includes a cabinet 12 in which an oven 14 is housed. Also, four surface gas burners 16 are mounted to extend through and above main top 18. Grates 20 are seated on main top 18 to support cooking utensils 22 above surface burners 16. Control panel 24 is used to control oven 14 and surface burners 16.

FIG. 1 is a copy of the FIG. 1 from U.S. Pat. No. 5,405,263 having the title, "Sealed gas burner assembly," having the inventors Gerdes et al., issued on Apr. 11, 1995, from which figure copy all of the reference numerals present in the original figure, as it appears in U.S. Pat. No. 5,405, .263, have been removed. U.S. Pat. No. 5,405,263 is hereby incorporated by reference as if set forth in its entirety. The reference numerals that have been removed from the figure for this U.S. Pat. No. 5,405,263, essentially reproduced herein as FIG. 1, indicate arrangements that are well known in the prior art.

Figure 2:
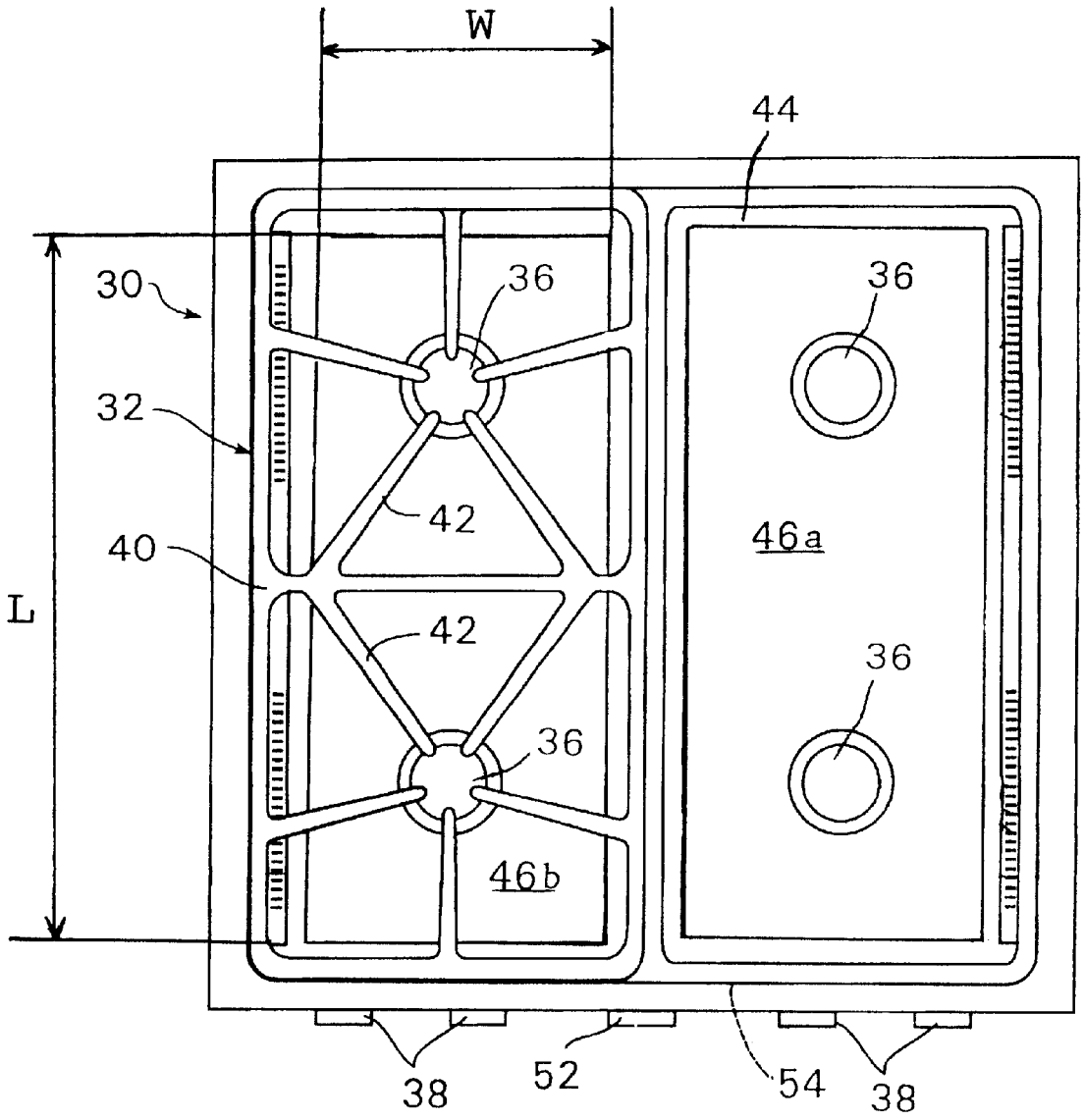
FIG. 2 is a top plan view of a gas cooking appliance.
Figure 3:
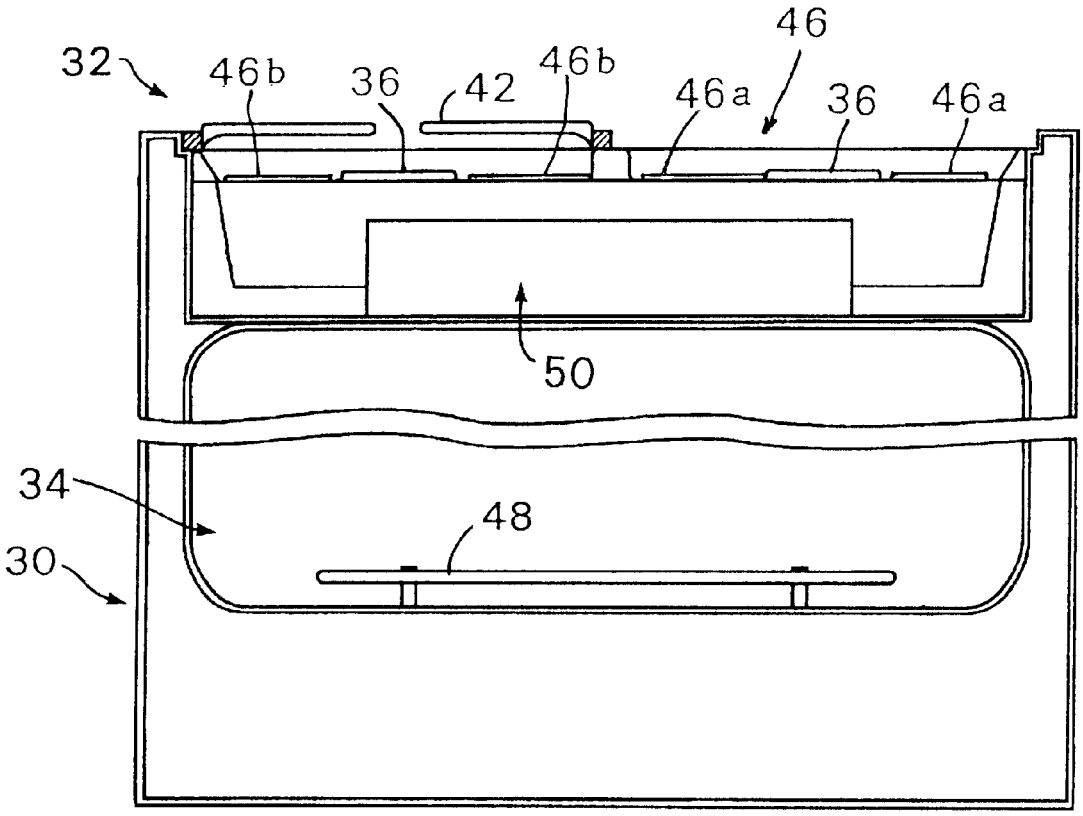
FIG. 3 is front elevation of a gas cooking appliance.

Referring now to FIGS. 2 and 3, a cooking range 30 of the free-standing type having both a cooktop portion 32 and a cooking oven 34 (FIG. 3) is illustrated. The cooktop 32 is illustrated as having four gas burners 36 (FIG. 2), but the cooktop 32 could be provided with more burners and one or more of the burners could be replaced with electric heating elements. The burners 36 are individually controlled by four knobs 38 in a conventional manner. A removable grate 40 is provided on top of the cooktop 32 to extend from the front to the back with a plurality of fingers 42 for supporting cooking pans or the like utensils above a front gas burner 36 and a back gas burner 36. In FIGS. 2 and 3, the right hand grate 40 has been removed for clarity of illustration and also it will be understood that when the gas burners 36 are replaced by electric heating elements, the grate 40 will be omitted. A plate, which can serve as drip tray, is identified by reference numeral 44. Plate 44 extends from front to back and side to side of the cooktop 32, and surrounds the burners 36 such as for catching spills from the cooking pans. Plate 44 may be removable or permanently affixed to the range 32. by corresponding retaining means 54.

The cooking oven 34 (FIG. 3) of the range 30 is positioned in a conventional manner below the cooktop 32. The oven 34 is provided with a bottom heating element 48, which is shown here as an electric heating element but also can be a gas burner element. Normally, the cooking oven 34 would also be provided with a broiler element, which may be an electric element, an open flame gas burner, or an infrared gas broiler, generally designated by reference numeral 50. The cooking oven 34 is separately. controlled by a knob 52 on the front of the range 30.

The cooking range 30 may be of the built-in type.

Atop of plate 44 is disposed a layer generally identified by reference numeral 46, or a plurality of layers disposed adjacent to one another can be disposed atop plate 44.

In the embodiments of FIGS. 2 and 3, two layers, right layer 46*a* and left layer 46*b* are disposed on the plate 44. These layers 46*a* and 46*b* serve to fully cover the plate 44.

As can best be seen in FIG. 2, the layer 46*b* has an areal extent comprising length L, which may be the same as the length of the plate 44 and a width which may be the same as the width of the plate 44. As shown in FIG. 2, there are provided two layers 46*a* and 46*b,* respectively, to cover the width of the plate 44. The length and the width of the layer may be changed to suit a particular model of cooktop or hob top.

FIGS. 2 and 3 are respectively copies of FIGS. 1 and 2 from U.S. Pat. No. 6,098,613 having the title, "Venting system for gas oven," having the inventor Wiersma, issued on Aug. 8, 2000, from which figure copies the reference numerals present in the original figures, as they appear in U.S. Pat. No. 6,098,613, have been removed. U.S. Pat. No. 6,098,613 is hereby incorporated by reference as if set forth in its entirety. The reference numerals that have been removed from the figures for this U.S. Pat. No. 6,098,613, essentially reproduced herein as FIGS. 2 and 3, indicate arrangements that are well known in the prior art.

Figure 4:
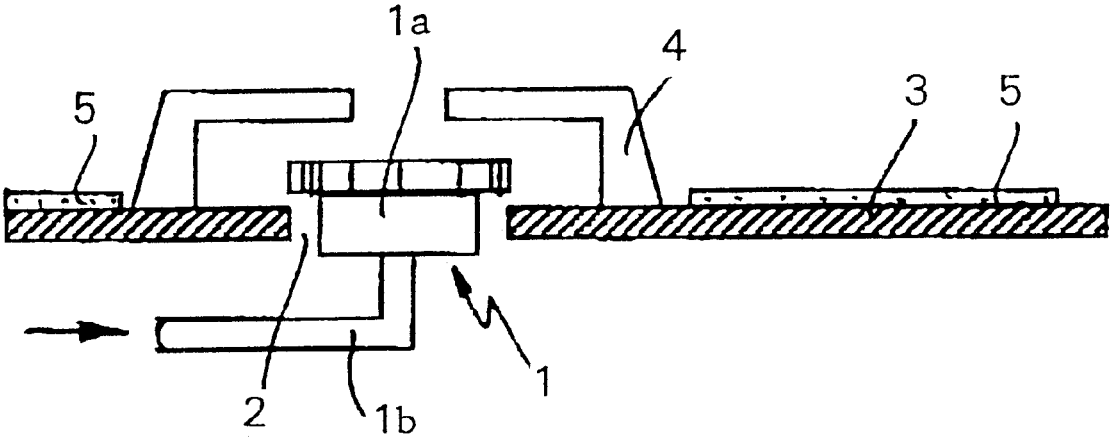
FIG. 4 is a schematic of the burner region of a cooktop or hob top.

FIG. 4 shows a section of a cooktop with an atmospheric gas burner 1 with a burner head la which is supplied with natural gas and/or a mixture of gas and air by.means of a feed tube 1*b* in the manner of the prior art. The burner head 1*a* is housed in a boring 2 of a cover plate 3 which in practical terms is the cooktop. Around this boring there is typically a metal collar which forms a seal against overflowing food and simultaneously protects. the edge of the cover plate 3 against mechanical impacts. This collar is not shown in the figure for purposes of simplicity.

The drawing also shows a pot holder 4 which sits on the cover plate 3 and on which the pots and pans etc. are placed over the gas burner 1. The pot holder can be located in a sheet metal trough which is fastened underneath this boring, even for large diameter borings 2.

The cover plate 3 typically consists of a thermally or chemically tempered soda lime glass plate that is provided with a non-transparent printing or coating. Glass of this type gradually loses its temper as a function of the temperatures to which it is exposed, and it loses its temper faster, the higher the maximum temperature, as shown in the following table, which presents the allowable temperature to which the glass can be exposed as a function of the respective maximum operating temperature:

| | |
|---|---|
| 30 h | 310° C. |
| 100 h | 300° C. |

-continued

| | |
|---|---|
| 1,000 h | 290° C. |
| 10,000 h | 280° C. |

The height of the pot holder and the diameter of the boring 2 and the output of the gas burner 1 are therefore coordinated so that, as a rule, the temperature increase in the area of the glass plate around the burner caused by the hot combustion gases and the heat reflected by the cooking vessel can be kept within specified limits.

It has been determined, however, that it is possible for the maximum thermal limit to be exceeded in certain cooking situations, especially in unusual cooking situations, such as when a pot boils dry or when a very large pot is used that spans two gas burners. Tests conducted on commercially available units showed that the allowable maximum temperature that can be applied to the glass for a short period of time was exceeded by up to 20%, which at least significantly shortens the useful life of the glass plate, but can also cause the glass plate to break, i.e. it represents a hazard to safe operation.

To prevent this, at least in the area of the glass cover plate 3 that may be exposed to excessive temperatures, a thermally reflecting coating 5 is applied, which is indicated only schematically in the accompanying drawing. This coating reduces the temperatures that occur in the cover plate 3, i.e. it prevents temperatures higher than 310° C. from occurring in the glass cover plate 3, which are not permitted for reasons of the operational safety of the glass material. The invention therefore improves safety during operation.

The coating can be applied in the manner of the prior art, e.g. using thin-film technology and materials of the prior art (metals, oxides). The technology for the application of thermally reflecting coatings on glass is sufficiently well known that it does not need to be explained here in any further detail. Purely by way of example, reference is made to methods of vaporization, sputtering, immersion and spraying or currentless vapor deposition techniques. Between the thermally reflecting coating and the surface of the glass, an intermediate layer can also be applied which protects the glass against harmful diffusion processes or has a reflection-reducing action, i.e. it prevents the thermally reflective coating from producing undesirable color effects.

Depending on the desired design, the coating can also be colored, or even multi-colored in the manner of a decoration.

The coating can extend over the entire surface of the plate. The coating should be applied at least in the areas of the plate that are subject to particularly severe thermal stresses, i.e. in the vicinity of the burners and between them.

Instead of a glass plate made of thermally or chemically tempered glass, a cover plate made of borosilicate glass can also be used, to which a maximum temperature of 310° C. can also be applied.

The invention can also be used with gas cooktops with a glass ceramic plate, although in that case it is not so much a question of protecting the glass ceramic material, because it can survive high tem peratures, but of protecting the components such as the temperature-sensitive electronic components that are located underneath the plate.

Other temperature-limited materials such as plastic can also be used for the construction of the plate 3.

In addition to increasing the safety of operation by reducing the temperature in the surface of the plate 3, the invention advantageously also gives the designer greater freedom in the design of the cooktop with the atmospheric gas burners.

Smaller borings 2 can be realized,

Theoretically, the metal collar can be eliminated, and

Flatter burners 1 can be used, i.e. in general, the distance between the pot-holding surface of the pot holder 4 and the plate 3 can be reduced, and the burner pans can be smaller.

The coating also guarantees greater chemical resistance to conventional household cleaning agents.

The thermally reflecting coating also provides additional thermal protection of the components that are located underneath the cover plate, such as the temperature-sensitive electronic components. Improved protection is also provided for any temperature-sensitive organic pigments that may be applied.

Figure 5:
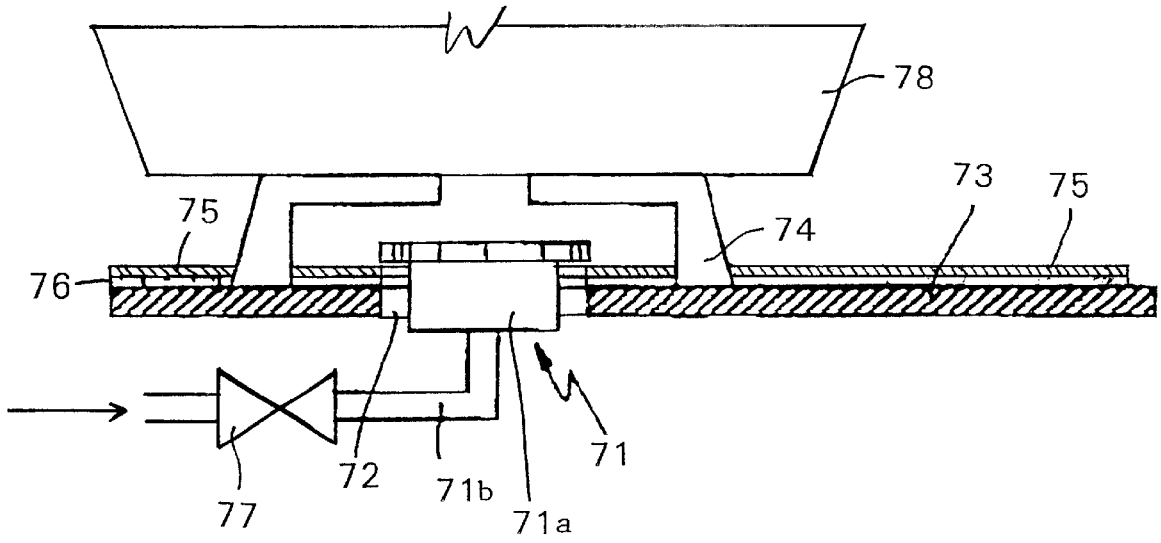
FIG. 5 is a view similar to FIG. 4 and showing additional details.

FIG. 5 illustrates a gas burner 71 disposed in a cutout 72. The burner head 71*a* is supplied with gas through line 71*b* which is controlled by a valve 77. A cooking utensil 78 is positioned on the grate 74. The plate 73 is respectively coated by a layer 76 which provides a protective and/or reflection and/or diffusion reducing function. Atop of layer 75 is provided a thermally reflecting coating or layer 75. Both layers 75 and 76 extend to and about the cutout 72.

Figure 6:
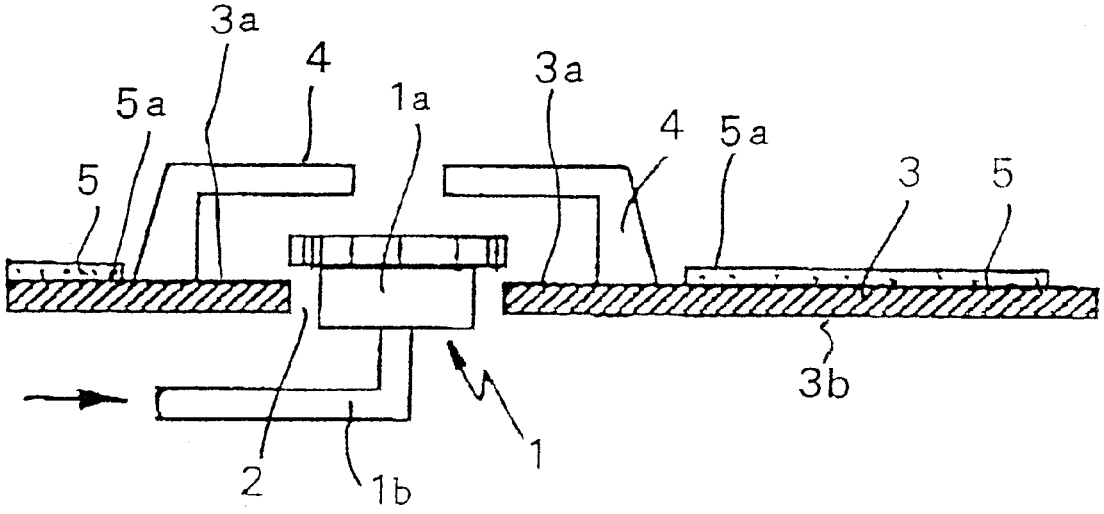
FIG. 6 is a view similar to FIG. 4 and showing additional detail.

FIG. 6 substantially illustrates the components of FIG. 4, it being indicated that the portions 5*a* atop plate 3 and adjacent the grating 4 of the layer 5 possibly provide a heat sink, that is, heat from portions 3*a* of the plate 3 is withdrawn by the layer 5 comprised of the portions 5*a* adjacent the cutout 2 and the remainder of the layer 5. Furthermore, it is indicated that a portion 3*b* of plate 3 is covered by layer 5.

Thus, in the prior art overheating can be prevented by selecting the diameter of the borings in the glass covers that hold the atmospheric gas burners as large as possible, and by placing a sheet metal pan underneath them. The edge of the boring is also enclosed by a collar.

One feature of the invention resides broadly in a cooktop with at least one atmospheric gas burner (1) which is located in a boring (2) in a plate-shaped cover (3) made of temperature-limited material, characterized by the fact that a thermally reflecting coating (5) is applied to the upper side of the cover plate (3).

Another feature of the invention resides broadly in a cooktop characterized by the fact that the cover plate (3) is formed by a thermally or chemically tempered soda lime plate.

Yet another feature of the invention resides broadly in a cooktop characterized by the fact that the cover plate (3) is formed by a plate made of borosilicate glass.

Still another feature of the invention resides broadly in a cooktop characterized by the fact that the cover plate (3) is made of non-transparent plastic.

A further feature of the invention resides broadly in a cooktop characterized by the fact that the cover plate (3) is made of glass ceramic.

Another feature of the invention resides broadly in a cooktop characterized by the fact that the coating (5) is colored.

Yet another feature of the invention resides broadly in a cooktop characterized by the fact that the coating (5) is decorative.

Still another feature of the invention resides broadly in a cooktop characterized by the fact that between the cover plate (3) and the thermally reflecting coating (5), an intermediate coating is applied that has a protective and/or reflection-reducing function.

A further feature of the invention resides broadly in a cooktop characterized by the fact that the entire plate surface is coated.

Another feature of the invention resides broadly in a cooktop characterized by the fact that only the areas of the cover plate (3) that are subjected to severe thermal stresses are coated.

Thus, there is provided a cooktop with at least one atmospheric gas burner that is held in a boring in a plate-shaped cover made of temperature-limited material.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent documents, namely, Federal Republic of Germany Patent Application No. 200 16 145.8, filed on Sep. 18, 2000, having inventor Torsten GABELMANN, and DE-OS 200 16 145, having inventor Torsten GABELMANN, and DE-PS 200 16 145, having inventor Torsten GABELMANN, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

Another foreign patent publication application, namely, Federal Republic of Germany Patent Application No. DE 100 17 698.4-45, filed on Apr. 8, 2000, having inventors Sabine MELSON, Kurt SCHAUPERT, and Dr. Peter NASS, and DE-OS 100 17 698 and DE-PS 100 17 698, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Another foreign patent publication, nam ely, Federal Republic of Germany Patent Application No. DE 100 17 701.8-45, filed on Apr. 8, 2000, having inventors Dr. Friedrich SIEBERS, Dr. Peter NASS, Dr. Gerhard LAUTENSCHLÄGER, and Dr. Otmar BECKER, and DE-OS 100 17 701 and DE-PS 100 17 701, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Yet another foreign patent publication application, namely, Federal Republic of Germany Patent Application No. DE 100 17 699.2-45, filed on Apr. 8, 2000, having inventors Dr. Sabine MELSON, Stefan HUBERT, and Thomas KARSCHTI, and DE-OS 100 17 699 and DE-PS 100 17 699, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

A further foreign patent publication application, namely, Federal Republic of Germany Patent Application No. DE 100 17 696.8-33, filed on Apr. 8, 2000, having inventors Dr. Sabine MELSON and Dr. Peter NASS, and DE-OS 100 17 696 and DE-PS 100 17 696, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

A further foreign patent publication application, namely, Federal Republic of Germany Patent Application No. DE 100 32 733.8-16, filed on Jul. 5, 2000, having inventors Kurt LEUTNER and Oliver GROS, and DE-OS 100 32 733 and DE-PS 100 32 733, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at Applicant's option, into the claims during prosecution as further limitations in the claims to patentably distinguish any amended claims from any applied prior art.

The following U.S. Patent Application is to be incorporated by reference as follows: U.S. patent application No. 09/828,288, filed on Apr. 6, 2001, entitled, "A cooking arrangement for cookin gfood such as a stove, a cooktop, and other cooking appliances, with an easy-to-clean surface," having inventors Dr. Sabine MELSON, Dr. K. SCHAUPERT, and Dr. Peter NASS, is hereby incorporated by reference as if set forth in its entirety herein.

The following U.S. Patent Application is to be incorporated by reference as follows: U.S. patent application No.09/829,409, entitled "Flat Float Glass," having inventors Dr. Friedrich SIEBERS, Dr. Peter NAβ, Dr. Gerhard LAUTENSCHLÄGER, and Dr. Otmar BECKER, filed on Apr. 9, 2001 is hereby incorporated by reference as if set forth in its entirety herein.

The following U.S. Patent Application is to be incorporated by reference as follows: U.S. patent application Ser. No. 09/828,287, entitled, "A Building for Containing Human Occupants in an Adverse Arctic or Antarctic Environment and Structures for Containing and Protecting Human Occupants in an Adverse Environment," having inventors Dr. Sabine MELSON, Stefan HUBERT, and Thomas KARSCHTI, filed on Apr. 6, 2001 is hereby incorporated by reference as if set forth in its entirety herein.

The following U.S. Patent Application is to be incorporated by reference as follows: U.S. patent application Ser. No. 09/828,286, entitled, "Lamp with an Unpolished Surface and Radiant Source Lamps with a Transparent Cover for the Radiant Source," having inventors Dr. Sabine MELSON and Dr. Peter NASS, filed on Apr. 6, 2001 is hereby incorporated by reference as if set forth in its entirety herein.

The following U.S. Patent Application is to be incorporated by reference as follows: U.S. patent application No. 09/898,918, entitled, "Viewing window for household appliances," having inventors Kurt LEUTNER and Oliver GROS, filed on Jul. 3, 2001 is hereby incorporated by reference as if set forth in its entirety herein.

All of the patent references and their published equivalents anywhere, and the references in which they are cited, are hereby incorporated as if set forth in their entirety herein.

With respect to temperature ranges, these are to be understood to include within the range of degrees, steps of degrees in at least a tenth of a degree, or smaller, such that any tenth of a degree may be a limit of a diminished range of degrees.

The following U.S. Patents are to be incorporated by reference herein as follows: U.S. Pat. No. 6,021,774, having inventors TAPLAN et al., issued on Feb. 8, 2000; U.S. Pat. No. 6,148,812, having inventors TAPLAN et al., issued on Nov. 21, 2000; U.S. Pat. No. 6,002,112, having inventors NAβ et al., issued on Dec. 14, 1999;U.S. Pat. No. 6,111,229, having inventor SCHULTHEIS, issued on Aug. 29, 2000; U.S. Pat. No. 6,050,176, having inventors SCHULTHEIS et al., issued on Apr. 18, 2000; and U.S. Pat. No. 6,236,024, having inventors GOTZ et al., issued on May 22, 2001, are hereby incorporated by reference as if set forth in their entirety herein.

The following U.S. Patent Application is to be incorporated by reference as follows: U.S. patent application Ser. No. 09/522,460, entitled, "Cooking unite, such as a stove, for cooking food," inventors Dipl.-Ing. Michael MUSKALLA, Keramik-Ing. Werner HOTTUM, and Dipl.-Ing. Bernd SCHULTHEIS, filed on Mar. 9, 2000 is hereby incorporated by reference as if set forth in its entirety herein.

A further foreign patent publication application, namely, Federal Republic of Germany Patent Application No. DE 199 10 467.0-16, corresponding to the U.S. application Ser. No. 09/522,460 mentioned in the immediately preceding paragraph, filed on Mar. 10, 1999, having inventors Dipl.-Ing. Michael MUSKALLA, Keramik-Ing. Werner HOTTUM, and Dipl.-Ing. Bernd SCHULTHEIS, and DE-OS 199 10 467.0-16 and DE-PS 199 10 467.0-16, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. Patent Application is to be incorporated by reference as follows: U.S. patent application Ser. No. 09/898,892, entitled, "A cooking stove having a smooth-top glass ceramic cooktop, and a smooth-top glass ceramic cooktop with a glass ceramic cooktop cooking surface, method for production of stoves with smooth-top glass ceramic cooktops and smooth-top glass ceramic cooktops," having inventors Dr. Ina MITRA, Dr. Friedrich SIEBERS, Dr. Otmar BECKER, Dr. Andreas SCHMINKE, Dr. Bernd RÜDINGER, Christian ROOS, Dr. Evelin WEISS, Roland DUDEK, Dr. Erich RODEK, Georg-Friedrich SCHRÖDER, filed on Jul. 3, 2001, is hereby incorporated by reference as if set forth in its entirety herein.

A further foreign patent publication application, namely, European Patent Application No. EP 00114268.6, corresponding to the, U.S. application Ser. No. 09/898,892 mentioned in the immediately preceding paragraph, filed on Jul. 4, 2000, having inventors Dr. Ina MITRA, Dr. Friedrich SIEBERS, Dr. Otmar BECKER, Dr. Andreas SCHMINKE, Dr. Bernd RÜDINGER, Christian ROOS, Dr. Evelin WEISS, Roland DUDEK, Dr. Erich RODEK, Georg- Friedrich SCHRÖDER, as well as its published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. Patent Application is to be incorporated by reference as follows: U.S. patent application Ser. No. 09/758,953, entitled, "Stove or grill for cooking, and stove or grill for cooking having a glass ceramic cooktop or hob, and a glass ceramic plate cooktop or hob for use in a stove or grill," having inventors Ioannis KOSMAS, Dietmar WENNEMANN, and Joachim GRUTZKE, filed on Jan. 11, 2001 is hereby incorporated by reference as if set forth in its entirety herein.

A further foreign patent publication application, namely, Federal Republic of Germany Patent Application No. DE 100 00 657.4-16, corresponding to the U.S. Patent application Ser. No. 09/758,953 referred to in the immediately preceding paragraph, filed on Jan. 11, 2000, having inventors Ioannis KOSMAS, Dietmar WENNEMANN, and Joachim GRUTZKE, entitled, "Glaskeramikplatte," and DE-OS 100 00 657 and DE-PS 100 00 657, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. Patent Application is to be incorporated by reference as follows: U.S. patent application Ser. No. 09/866,989, entitled, "Method of treating a smooth-top kitchen ceramic or glass ceramic cooktop cooking surface of a smooth-top kitchen ceramic or glass ceramic cooktop or a stove having a ceramic or glass ceramic cooktop cooking surface, and a device therefor," having inventors Bernd SCHULTHEIS and Monica DE WITZMANN, filed on May 29, 2001 is hereby incorporated by reference as if set forth in its entirety herein.

A further foreign patent publication application, namely, Federal Republic of Germany Patent Application No. DE 100 26 824.2-15, corresponding to the U.S. Patent application Ser. No. 09/866,989 referred to in the immediately preceding paragraph, filed on May 30, 2000, having inventors Bernd SCHULTHEIS and Monica DE WITZMANN, entitled, "Reinigungsschaber," and DE-OS 100 26 824 and DE-PS 100 26 824, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. Patent Application is to be incorporated by reference as follows: U.S. patent application Ser. No. 09/931,586, entitled, "A stove for cooking food and like appliances with a door having a window and a temperature indicating device thereon," having inventors Kurt LEUTNER, Oliver GROS, Joachim GRÜTZKE, Bernhard GÖTZ, and Walter GRAMLICH, filed on Aug. 16, 2001 is hereby incorporated by reference as if set forth in its entirety herein.

A further foreign patent publication application, namely, Federal Republic of Germany Patent Application No. DE 100 40 321.2, corresponding to the U.S. Patent application Ser. No. 09/931,586 referred to in the immediately preceding paragraph, filed on Aug. 17, 2000 having inventors Kurt LEUTNER, Oliver GROS, Joachim GRÜTZKE, Bernhard GÖTZ, and Walter GRAMLICH, and DE-OS 100 40 321.2 and DE-PS 100 40 321.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. Patents being of interest in connection with cooktops are to be incorporated by reference-herein as follows: U.S. Pat. No. 6,024,084, having inventor Gerhardinger, issued on Feb. 15, 2000, entitled, "Double sided heat barrier glass with clear CVD coating and method of making the same"; U.S. Pat. No. 5,958,272, having inventors Taplan et al., issued on Sep. 28, 1999, entitled, "Cooktop with a glass or glass ceramic cooking surface"; and U.S. Pat. No. 4,413,171, having inventor Klammers, issued on Nov. 1, 1983, entitled, "Electric cooking oven for domestic use," are hereby incorporated by reference as if set forth in their entirety herein.

Some examples of stoves and ranges which may possibly be utilized or possibly adapted for use in at least one possible embodiment of the present invention may be found in the following U.S. Patents: U.S. Pat. No. 5,083,010, having inventors Henry et al., issued on Jan. 21, 1992; U.S. Pat. No. 4,601,279, having inventor Guerin, issued on Jul. 22, 1986; U.S. Pat. No. 4,493,976, having inventor Wilson, issued on Jan. 15, 1985; U.S. Pat. No. 4,292,501, having inventor Maitenaz, issued on Sep. 29, 1981; U.S. Pat. No. 5,213,091, issued on May 25, 1993; U.S. Pat. No. D336,210, issued on Jun. 8, 1993; U.S. Pat. No. 5,280,152, issued on Jan. 18, 1994; U.S. Pat. No. 5,290,997, issued on Mar. 1, 1994; U.S. Pat. No. 5,400,765, issued on Mar. 28, 1995; U.S. Pat. No. D359,345, issued on Jun. 13, 1995; U.S. Pat. No. D361,015, issued on Aug. 8, 1995; and U.S. Pat. No. 5,464,005, issued on Nov. 7, 1995. The aforementioned patents are hereby incorporated by reference as if set forth in their entirety herein.

Some examples of burners and related components which may possibly be utilized or possibly adapted for use in at least one possible embodiment of the present invention may be found in the following U.S. Patents: U.S. Pat. No. 4,758,710, issued on Jul. 19, 1988; U.S. Pat. No. 4,899,723, issued on Feb. 13, 1990; U.S. Pat. No. 5,186,158, issued on Feb. 16, 1993; U.S. Pat. No. D333,943, issued on Mar. 16, 1993; U.S. Pat. No. 5,323,759, issued on Jun. 28, 1994; U.S. Pat. No. 5,329,918, issued on Jul. 19, 1994; U.S. Pat. No. 5,397,234, issued on Mar. 14, 1995; U.S. Pat. No. 5,397,873, issued on Mar. 14, 1995; U.S. Pat. No. 5,400,765, issued on Mar. 28, 1995; and U.S. Pat. No. 5,437,262, issued on Aug. 1, 1995. The aforementioned patents are hereby incorporated by reference as if set forth in their entirety herein.

Some examples of related components for stoves and ranges which may possibly be utilized or possibly adapted for use in at least one possible embodiment of the present invention may be found in the following U.S. Patents: U.S. Pat. No. 5,220,155, issued on Jun. 15, 1993; U.S. Pat. No. 5,245,159, issued on Sep. 14, 1993; U.S. Pat. No. 5,343,020, issued on Aug. 30, 1994; U.S. Pat. No. 5,377,660, issued on Jan. 3, 1995; U.S. Pat. No. 5,380,985, issued on Jan. 10, 1995; and U.S. Pat. No. 5,400,766, issued on Mar. 28, 1995. The aforementioned patents are hereby incorporated by reference as if set forth in their entirety herein.

Some examples of cooking hobs and cooktops which may possibly be utilized or possibly adapted for use in at least one possible embodiment of the present invention may be found in the following U.S. Patents: U.S. Pat. No. 5,406,932, issued on Apr. 18, 1995; U.S. Pat. No. 5,422,460, issued on Jun. 6, 1995; U.S. Pat. No. 5,424,512, issued on Jun. 13, 1995; U.S. Pat. No. 5,425,353, issued on Jun. 20, 1995; U.S. Pat. No. 5,429,114, issued on Jul. 4, 1995; and U.S. Pat. No. 5,448,036, issued on Sep. 5, 1995. The aforementioned patents are hereby incorporated by reference as if set forth in their entirety herein.

Some examples of ceramic.plates or hot plates which may be possibly utilized or possibly adapted for use in at least one possible embodiment of the present invention may be found in the following U.S. Patents: U.S. Pat. No. 3,596,650, issued on Aug. 3, 1971; U.S. Pat. No. 3,870,861, issued on Mar. 11, 1975; U.S. Pat. No. 4,414,465, issued on Nov. 8, 1983; U.S. Pat. No. 4,634,841, issued on Jan. 6, 1987; and U.S. Pat. No. 5,397,873, issued on Mar. 14, 1995. The aforementioned patents are hereby incorporated by reference as if set forth in their entirety herein.

Some examples of resistors printed on or disposed on a ceramic material which may possibly be utilized or possibly adapted for use in at least one possible embodiment of the present invention may be found in the following U.S. Patents: U.S. Pat. No. 4,004,130, issued on Jan. 18, 1977; U.S. Pat. No. 4,160,897, issued on Jul. 10, 1979; U.S. Pat. No. 4,762,982, issued on Aug. 9, 1988; U.S. Pat. No. 5,264,681, issued on Nov. 23, 1993; and U.S. Pat. No. 5,700,338, issued on Dec. 23, 1997. The aforementioned patents are hereby incorporated by reference as if set forth in their entirety herein.

Some examples of ceramic materials which may possibly be utilized or possibly adapted for use in at least one possible embodiment of the present invention may be found in the following U.S. Patents: U.S. Pat. No. 5,385,873, issued on Jan. 31, 1995; U.S. Pat. No. 5,407,740, issued on Apr. 18, 1995; U.S. Pat. No. 5,420,399, issued on May 30, 1995; U.S. Pat. No. 5,422,319, issued on Jun. 6, 1995; U.S. Pat. No. 5,449,649, issued on Sep. 12, 1995; U.S. Pat. No. 5,476,684, issued on Dec. 19, 1995; and U.S. Pat. No. 5,691,261, issued on Nov. 25, 1997. The aforementioned patents are hereby incorporated by reference as if set forth in their entirety herein.

Some examples of adhesive materials which may possibly be utilized or possibly adapted for use in at least one possible embodiment of the present invention may be found in the following U.S. Patents: U.S. Pat. No. 5,225,6.62, issued on Jul. 6, 1993; U.S. Pat. No. 5,268,338, issued on Dec. 7, 1993; U.S. Pat. No. 5,288,674, issued on Feb. 22, 1994; U.S. Pat. No. 5,300,627, issued on Apr. 5, 1994; U.S. Pat. No. 5,403,228, issued on Apr. 4, 1995; U.S. Pat. No. 5,432,320, issued on Jul. 11, 1995; U.S. Pat. No. 5,468,290, issued on Nov. 21, 1995; and U.S. Pat. No. 5,475,044, issued on Dec. 12, 1995. The aforementioned patents are hereby incorporated by reference as if set forth in their entirety herein.

Some examples of float glass and/or glass ceramics that may possibly be utilized or possibly adapted for use in at least one possible embodiment of the present invention may be found in the following U.S. Patents: U.S. Pat. No. 6,143,417, having inventors Nomura et al., issued on Nov. 7, 2000; U.S. Pat. No. 6,065,309, having inventors Cooper et al., issued on May 23, 2000; U.S. Pat. No. 5,723,172, having inventor Sherman, issued on Mar. 3, 1998; U.S. Pat. No. 5,846,279, having inventors Nomura et al., issued on Dec. 8, 1998; U.S. Pat. No. 5,665,424, having inventor Sherman, issued on Sep. 9, 1997; and U.S. Pat. No. 4,859,636, having inventors Aratani et al., issued on Aug. 22, 1989. The aforementioned patents are hereby incorporated by reference as if set forth in their entirety herein.

Some examples of flat glass production which may possibly be incorporated in a possible embodiment or example of the present invention may be found in U.S. Pat. No. 3,218,143 issued to De Lajarte on Nov. 16, 1965 and entitled "Process for the manufacture of flat glass"; U.S. Pat. No. 3,930,826 issued to Schornhorst on Jan. 6, 1976 and entitled "Conditioning flat glass for removal from supporting liquid following forming"; U.S. Pat. No. 3,938,979 issued to Plumat on Feb. 147, 1976 and entitled "Method and apparatus for vertically drawing a glass ribbon"; U.S. Pat. No. 4,801,321 issued to Pita et al. on Jan. 31, 1989 and entitled "Method for the manufacturing of glass sheets"; U.S. Pat. No. 4,214,886 issued to Shay et al. on Jul. 29, 1980 and entitled "Forming laminated sheet glass"; U.S. Pat. No. 4,209,315 issued to Spurling on Jun. 24, 1980 and entitled "Glass forming apparatus"; U.S. Pat. No. 4,929,266 issued to Cozac et al. on May 29, 1990 and entitled "Method of manufacturing glass"; and U.S. Pat. No. 5,078,777 issued to Cozac et al. on Jan. 7, 1992 and entitled "Glass-melting furnace", all of these U.S. Patents being hereby expressly incorporated by reference as if set forth in their entirety herein.

Some examples relating to aluminosilicate, features of which may possibly be incorporated in an embodiment of the present invention may be found in U.S. Pat. No. 4,084,974 issued to Beall et al. on Apr. 18, 1978 and entitled "Method of making light-absorbing glass-ceramic articles"; U.S. Pat. No. 4,530,909 issued to Makishima et al. on Jul. 23, 1985 and entitled "Aluminosilicate glass containing $Y_2O_3$ concentrate and $ZRO_2$"; U.S. Pat. No. 4,626,515 issued to Chyung et al. on Dec. 2, 1986 and entitled "Reinforced alkaline earth aluminosilicate glasses"; U.S. Pat. No. 4,846,866 issued to Chyung et al. on Jul. 11, 1989 and entitled "Providing reinforced alkaline earth aluminosilicate glasses"; and U.S. Pat. No. 6,060,168 issued to Kohli on May 9, 2000 and entitled "Glasses for display panels and photovoltaic devices", all of these U.S. Patents being hereby expressly incorporated by reference as if set forth in their entirety herein.

Some examples relating to float glass processes, features of which may possibly be incorporated in a possible embodiment of the present invention may be found in U.S. Pat. No. 4,305,745 issued to Mouly on Dec. 15, 1981 and entitled "Method of attenuating glass in a float process"; U.S. Pat. No. 4,342,583 issued to Kapura et al. on Aug. 3, 1982 and entitled "Apparatus and method for attenuating floating glass ribbon"; U.S. Pat. No. 4,357,156 issued to Seymour on Nov. 2, 1982 and entitled "Minimizing surface distortion while shaping glass sheets"; U.S. Pat. No. 4,402,722 issued to Edge on Sep. 6, 1983 and entitled "Cooling arrangement and method for forming float glass."; U.S. Pat. No. 4,741,7540 issued to Bricker on May 3, 1988 and entitled "Method an apparatus for cooling in a float glass forming operation"; and U.S. Pat. No. 5,643,349 issued to Piper et al on Jul. 1, 1997 and entitled "Apparatus for applying $SO_3$ to float glass", all of these U.S. Patents being hereby expressly incorporated by reference as if set forth in their entirety herein.

Some examples of keatite and/or high quartz mixed crystal formation, features of which may possibly be incorporated in a possible embodiment of the present invention may be found in the following U.S. Patents: U.S. Pat. No. 3,938,978 issued to Hummel on Feb. 17, 1976 and entitled, "Method of making crystallized glass," U.S. Pat. No. 3,970,463 issued to Planchock et al. on Jul. 20, 1976 and entitled, "Glasses and glass-ceramics and products made therefrom," U.S. Pat. No. 4,011,091 issued to McCollister on Mar. 8, 1977 and entitled, "Ceramic materials containing keatite," U.S. Pat. No. 4,100,001 issued to Franklin on Jul. 11, 1978 and entitled, "Thermally crystallizable glasses and glass-ceramics made therefrom," U.S. Pat. No. 4,391,914 issued to Beall et al. on Jul. 5, 1983 and entitled, "Strengthened glass-ceramic articles and method," U.S. Pat. No. 4,861,734 issued to MacDowell on Aug. 29, 1989 and entitled, "Alkaline earth aluminoborate glass-ceramics," U.S. Pat. No. 5,212,122 issued to Pannhorst et al. on May 18, 1993 and entitled, "Transparent colored glass ceramic with good thermal stability and variable transmission in the IR region," and U.S. Pat. No. 6,043,171 issued to Siebers et al. on Mar. 28, 2000 and entitled, "Lead-free and cadmium-free glass compositions for glazing, enamelling and decorating glass of glass-ceramics," all of these U.S. Patents being hereby expressly incorporated by reference as if set forth in their entirety herein.

Some examples of ceramizing or ceramising glass-ceramic or glass, features of which may possibly be incorporated in a possible embodiment of the present invention may be found in U.S. Pat. No. 4,824,463 issued to Neuhoff et al. on Apr. 25, 1989 and entitled "Process for ceramising glass-ceramic sheets"; and U.S. Pat. No. 4,851,022 issued to Günthner on Jul. 25, 1989 and entitled "Method and oven for ceramising glass plates", all of these U.S. Patents being hereby expressly incorporated by reference as if set forth in their entirety herein.

Some examples of crystallizable glass and glass-ceramics made therefrom, features of which may possibly be incorporated in a possible embodiment of the present invention may be found in U.S. Pat. No. 3,970,463 issued to Planchock et al. on Jul. 20, 1976 and entitled "Glasses and glass-ceramics and products made therefrom"; U.S. Pat. No. 4,011,091 issued to McCollister on Mar. 8, 1977 and entitled "Ceramic materials containing keatite"; U.S. Pat. No. 4,100,001 issued to Franklin on Jul. 11, 1978 and entitled "Thermally crystallizable glasses and glass-ceramics made therefrom"; U.S. Pat. No. 4,126,476 issued to Grossman on Nov. 21, 1978 and entitled "Aluminous quartz ceramics and method";. U.S. Pat. No. 4,391,914 issued to Beall et al. on Jul. 5, 1983 and entitled "Strengthened glass-ceramic article and method"; U.S. Pat. No. 6,197,710 B1 issued to Ōhara et al. on Mar. 6, 2001 and entitled "Luminous glass ceramics"; and U.S. Pat. No. 6,204,211 B1 issued to Ōhara et al. on Mar. 20, 2001 and entitled "Luminous glass ceramics", all of these U.S. Patents being hereby expressly incorporated by reference as if set forth in their entirety herein.

The chapter entitled,"Mechanisms of opacification," comprising pages 263 to 265 in Werner VOGEL, "Glass Chemistry," Springer-Verlag, Berlin, 1992, ISBN0-387-57572-3, is hereby incorporated by reference as if set forth in its entirety herein.

The following U.S. Patents, and their published equivalents, are hereby incorporated by reference as if set forth in their entirety herein as follows: U.S. Pat. No. 4,211,820 issued to Cantaloupe et al. on Jul. 8, 1980 and entitled, "Brown glass-ceramic articles," U.S. Pat. No. 4,218,512 issued to Allersma on Aug. 19, 1980 and entitled, "Strengthened translucent glass-ceramics and method of making," U.S. Pat. No. 5,070,045 issued to Comte et al. on Dec. 3, 1991 and entitled, "Transparent glass-ceramic article," and U.S. Pat. No. 5,173,453 issued to Beall et al. on Dec. 22, 1992 and entitled, "Variably translucent articles and method for making."

The following U.S. Patents, referring to temperature difference consideration in accordance with aspects of the inv ention, and the published equivalents of such patents, are hereby incorporated by reference as if set forth in their entirety herein: U.S. Pat. No. 5,763,343 issued to Brix et al. on Jun. 9, 1998 and entitled, "Fire regardant safety glass," U.S. Pat. No. 5,876,472 issued to Gros et al. on Mar. 2, 1999 and entitled, "Method for producing a chemically pretensioned glass body," U.S. Pat. No. 5,990,023 issued to Siedel et al. on Nov. 23, 1999 and entitled, "Fire-resistant glazing," U.S. Pat. No. 6,096,670 issued to Lautenschläger et al. on Aug. 1, 2000 and entitled, "Alkali metal-free aluminoborosilicate glass and its use," and U.S. Pat. No. 6,187,429 issued to Weinberg et al. on Feb. 13, 2001 and entitled, "Decorative ceramic color layers applied to glass or glass ceramic."

The following foreign references, referring to temperature difference resistance or temperature difference resiliency, and their published equivalents, are hereby incorporated by reference as if set forth in their entirety herein: Federal Republic of Germany Patent No. DE 199 34 072 C2 to SCHOTT GLAS and issued on Jun. 13, 2001; Federal Republic of Germany Patent No. DE 198 57 117 C2 issued to SCHOTT GLAS on May 3, 2001; and Federal Republic of Germany Patent No 42 44 048 C2 issued to FRICKE on Aug. 8, 1996.

Some examples of metal coating of glass, features of which may possibly be used or adapted for use in at least one embodiment of the present invention may be found in the following U.S. Patents: U.S. Pat. No. 5,112,440 issued to Banks et al. on May 12, 1992; U.S. Pat. No. 5,256,485 issued to Terneu et al. on Oct. 26, 1993; U.S. Pat. No. 5,632,942 issued to Yeh et al. on May 27, 1997; U.S. Pat. No. 5,718,980 issued to Koch et al. on Feb. 17, 1998; U.S. Pat. No. 5,858,456 issued to Nordlander on Jan. 12, 1999; U.S. Pat. No. 5,882,435 issued to Holdermann on Mar. 16, 1999; U.S. Pat. No. 5,925,415 issued to Fry et al. on Jul. 20, 1999; U.S. Pat. No. 5,953,478 issued to Sanghera et al. on Sep. 14, 1999; U.S. Pat. No. 6,093,452 issued to Ishii et al. on Jul. 25, 2000; and U.S. Pat. No. 6,207,221 issued to Schulz-Harder on Mar. 27, 2001. All of these U.S. Patents are being hereby expressly incorporated by reference as if set forth in their entirety herein.

Some examples of non-glare coated glass, features of which may possibly be used or adapted for use in at least one embodiment of the present invention may be found in the following U.S. Patents: U.S. Pat. No. 4,578,100 issued to Breininger on Mar. 25, 1986; U.S. Pat. No. 4,636,439, issued to Breininger on Jan. 13, 1987; U.S. Pat. No. 4,944,986 issued to Zuel on Jul. 31, 1990; U.S. Pat. No. 5,196,088 issued to Soda on Mar. 23, 1993; U.S. Pat. No. 5,318,724 issued to Hasegawa et al. on Jun. 7, 1994; U.S. Pat. No. 5,334,409 issued to Sohn et al. on Aug. 2, 1994; U.S. Pat. No. 5,490,161 issued to Tanuma on Feb. 6, 1996; and U.S. Pat. No. 6,238,781 issued to Anderson et al. on May 29, 2001. All of these U.S. Patents are being hereby expressly incorporated by reference as if set forth in their entirety herein.

Some examples of tempered glass, features of which may possibly be used or adapted for use in at least one embodiment of the present invention may be found in the following U.S. Patents: U.S. Pat. No. 3,938,980 issued to French on Feb. 17, 1976; U.S. Pat. No. 4,620,864 issued to McMaster on Nov. 4, 1986; U.S. Pat. No. 4,681,616 issued to McMaster on Jul. 21, 1987; U.S. Pat. No. 4,735,646 issued to Aratani et al. on Apr. 5, 1988; U.S. Pat. No. 6,079,227 issued to Yoshizawa et al. on Jun. 27, 2.000; and U.S. Pat. No. 6,257,228 issued to Braccini on Jul. 10, 2001. All of these U.S. Patents are being hereby expressly incorporated by reference as if set forth in their entirety herein.

Some examples of heat resistant plastic/synthetic material, features of which may possibly be used or adapted for use in at least one embodiment of the present invention may be found in the following U.S. Patents: U.S. Pat. No. 4,430,688 issued to Tamura et al. on Feb. 7, 1984; U.S. Pat. No. 4,798,937 issued to Guerrero on Jan. 17, 1989; U.S. Pat. No. 5,121,461 issued to Yamamoto et al. on Jun. 9, 1992; U.S. Pat. No. 5,178,816 issued to Suzuki et al. on Jan. 12, 1993; U.S. Pat. No. 5,243,964 issued to Kos on Sep. 14, 1993; and U.S. Pat. No. 6,252,205 issued to Schultheis on Jun. 26, 2001. All of these U.S. Patents are being hereby expressly incorporated by reference as if set forth in their entirety herein.

Some examples of soda lime glass and tempered soda lime glass, features of which may possibly be used or adapted for use in at least one embodiment of the present invention may be found in the following U.S. Patents: U.S. Pat. Nos. 3,935,681; 4,026,691; 4,123,778; 4,162,826; 4,757,162; 4,259,409; 4,769,058; 5,877,102; 5,877,103; 5,928,793; 5,939,175; and 6,063,718. All of these U.S. Patents are being hereby expressly incorporated by reference as if set forth in their entirety herein.

Some examples of coating by vapor deposition, features of which may possibly be used or adapted for use in at least one embodiment of the present invention may be found in the following U.S. Patents: U.S. Pat. No. 4,835,040 issued to Callies et al. on May 30, 1989; U.S. Pat. No. 4,900,110 issued to Sleighter on Feb. 13, 1990; U.S. Pat. No. 5,217,753 issued to Goodman et al. on Jun. 8, 1993; U.S. Pat. No. 5,401,305 issued to Russo et al. on Mar. 28, 1995; U.S. Pat. No. 5,798,142 issued to Soubeyrand on Aug. 25, 1998; U.S. Pat. No. 6,235,343 issued to Joret et al. on May 22, 2001; and U.S. Pat. No. 6,238,738 issued to McCurdy on May 29, 2001. All of these U.S. Patents are being hereby expressly incorporated by reference as if set forth in their entirety herein.

Some examples of coating by sputtering, features of which may possibly be used or adapted for use in at least one embodiment of the present invention may be found in the following U.S. Patents: U.S. Pat. No. 4,274,936 issued to Love on Jun. 23, 1981; U.S. Pat. No. 4,462,883 issued to Hart on Jul. 31, 1984; U.S. Pat. No. 5,073,451 issued to Iida et al. on Dec. 17, 1991; U.S. Pat. No. 5,112,675 issued to Wuest et al. on May 12, 1992; U.S. Pat. No. 6,039,850 issued to Schulz on Mar. 20, 2000; and U.S. Pat. No. 6,190,776 issued to Demiryont on Feb. 20, 2001. All of these U.S. Patents are being hereby expressly incorporated by reference as if set forth in their entirety herein.

Some examples of coating by dipping, features of which may possibly be used or adapted for use in at least one embodiment of the present invention may be found in the following U.S. Patents: U.S. Pat. No. 4,081,254 issued to Matsumoto et al. on Mar. 28, 1978; U.S. Pat. No. 4,842,630 issued to Braithwaith et al. on Jun. 27, 1989; U.S. Pat. No. 5,492,613 issued to Zhang et al. on Feb. 20, 1996; U.S. Pat. No. 5,572,086 issued to Tong et al. on Nov. 5, 1996; U.S. Pat. No. 5,858,052 issued to Kopylov on Jan. 12, 1999; and U.S. Pat. No. 6,050,870 issued to Suginoya et al. on Apr. 18, 2000. All of these U.S. Patents are being hereby expressly incorporated by reference as if set forth in their entirety herein.

Some examples of coating by spraying, features of which may possibly be used or adapted for use in at least one embodiment of the present invention may be found in the following U.S. Patents: U.S. Pat. No. 4,917,717 issued to Thomas et al. on Apr. 17, 1990; U.S. Pat. No. 5,124,211 issued to Kawahara et al. on Jun. 23, 1992; U.S. Pat. No. 6,099,905 issued to Rouquette et al. on Aug. 8, 2000; U.S. Pat. No. 6,120,661 issued to Hirano et al. on Sep. 19, 2000; U.S. Pat. No. 6,177,186 issued to Skoog et al. on Jan. 23, 2001; and U.S. Pat. No. 6,254,938 issued to Pranevicius et al. on Jul. 3, 2001. All of these U.S. Patents are being hereby expressly incorporated by reference as if set forth in their entirety herein.

Some examples of coating by electroless metallizing, features of which may possibly be used or adapted for use in at least one embodiment of the present invention may be found in the following U.S. Patents: U.S. Pat. Nos. 4,448,811; 4,913,768; 4,997,686; 5,035,924; 5,304,403; and 6,221,440. All of these U.S. Patents are being hereby expressly incorporated by reference as if set forth in their entirety herein.

Some examples of hob tops, features of which may possibly be used or adapted for use in at least one embodiment of the present invention may be found in the following. U.S. Patents: U.S. Pat. Nos. 4,827,108; 4,859,835; 5,132,657; 5,531,389; 5,785,047; 6,119,678; 6,174,482; and 6,210,618. All of these U.S. Patents are being hereby, expressly incorporated by reference as if set forth in their entirety herein.

Some further examples of glass ceramics, features of which may possibly be used or adapted for use in at least one embodiment of the present invention may be found in the following U.S. Patents; U.S. Pat. Nos. 5,562,957; 5,660,934; 5,718,970; 5,739,180; 5,844,206; 5,885,663; 5,895,302; 5,990,457; 6,120,282; 6,124,576; 6,170,479; 6,209,534; and 6,236,024. All of these U.S. Patents are being hereby expressly incorporated by reference as if set forth in their entirety herein.

Some examples of oxide coating, features of which may possibly be used or adapted for use in at least one embodiment of the present invention may be found in the following U.S. Patents: U.S. Pat. Nos. 5,256,485; 5,356,718; 5,453,304; 5,599,369; . 5,698,262; 5,773,086; 6,238,738; 6,248,397; and 6,268,059. All of these U.S. Patents are being hereby expressly incorporated by reference as if set forth in their entirety herein.

Some examples of heat reflecting coatings, features of which may possibly be used or adapted for use in at least one embodiment of the present invention may be found in the following U.S. Patents: U.S. Pat. Nos. 4,188,452; 4,216,259; 4,232,062; 4,323,598; 4,521,454; 4,668,048; 4,985,312; 5,085,926; 5,418,039; and 5,894,047. All of these U.S. Patents are being hereby expressly incorporated by reference as if set forth in their entirety herein.

Some examples of borosilicate glass, features of which may possibly be used or adapted for use in at least one embodiment of the present invention may be found in the following U.S. Patents: U.S. Pat. Nos. 4,313,748; 4,386,164; 4,438,210; 4,455,160; 4,536,329; 4,537,703; 4,870,034; 4,944,784; 5,480,846; 5,612,262; 6,050,176; and 6,204,212. All of these U.S. Patents are being hereby expressly incorporated by reference as if set forth in their entirety herein.

Some examples of providing a pattern or coloring, features of which may possibly be used or adapted for use in at least one embodiment of the present invention may be found in the following U.S. Patents: U.S. Pat. Nos. 6,114,054; 6,183,939; 6,187,429; 6,214,414; 6,228,194; 6,248,492; and 6,287,996. All of these U.S. Patents are being hereby expressly incorporated by reference as if set forth in their entirety herein.

Some examples of non-transparent plastic, features of which may possibly be used or adapted for use in at least one embodiment of the present invention may be found in the following U.S. Patents: U.S. Pat. Nos. 4,348,431; 4,427,743; 5,915,780; 6,216,855; 6,228,289; and 6,265,054. All of these U.S. Patents are being hereby expressly incorporated by reference as if set forth in their entirety herein.

Some examples of stove or gas burner controls, features of which may possibly be used or adapted for use in at least one embodiment of the present invention may be found in the following U.S. Patents: U.S. Pat. Nos. 4,448,186; 4,681,084; 4,834,188; 5,094,259; 6,253,761; and 6,280,180. All of these U.S. Patents are being hereby expressly incorporated by reference as if set forth in their entirety herein.

The following is in reference to coating of the plate. It is well known to provide tin oxide coated glass. Tin oxide coatings may be rendered conductive so that the coating reduces the emissivity of the coated glass in respect of long wavelength infra-red radiation, in particular radiation having wavelengths greater than 3 micrometers.

It is known to render tin oxide coatings conductive by incorporating doping agents, and they may also include minor proportions of other compatible materials for various purposes. The nature and amount of any atoms present other than tin and oxygen should not exceed a limit above which the crystal lattice structure type of the coating differs from that of cassiterite, so as to preserve the transparency and durability of the coating. A simple, and perhaps simplistic, explanation of doping is that atoms are provided which are compatible with the tin oxide crystal lattice, and which have a different valency shell from both tin and oxygen. As a result, the doping atoms provide spare electrons, or electron gaps which can act as charge carriers through the coating.

Such coated glass is often used for glazing purposes to provide a measure of heat conservation, and also to provide a heat screen, for example a solar screen. Most solar radiation energy is at relatively short wavelengths, so that it can be transmitted by the coated glass provided that the coating and the glass are clear, but radiant energy from the interior of the glazed structure tends to be at longer wavelengths, so it is inhibited from escaping from the structure through the coated glazing. Such coatings are often made to a thickness in the range 200 nm to 800 nm.

One such product comprises float glass on which a tin oxide coating some 750 nm to 800 nm in thickness has been formed pyrolytically. This coating has excellent low emissivity, less than 0.2. Such low emissivity is in fact as good as can be achieved by applying a coating by a sputtering technique. The coating also has good colour in reflection, in that it is a barely perceptible green. But because of its thickness, and also due to formation of the coating by pyrolysis, this coating has a level of haze which, while it is commercially acceptable for many purposes, is not as good as it could be. Some contrast in the haze over the extent of the coating area may also be apparent on inspection. When this coating is polished so as substantially to eliminate surface haze, any residual haze may be attributed to defects below the surface of the coating. This residual haze is referred to herein as internal haze. This known coating has an average internal haze value of 2%.

Typically, coated glass articles are produced by continuously coating a glass substrate while it is being manufactured in a process known in the art as the "Float Glass Process". This process involves casting glass onto a molten tin bath which is suitably enclosed, then transferring the glass, after it has sufficiently cooled, to take-away rolls which are aligned with the bath, and finally cooling the glass as it advanced across the rolls, initially through a lehr and thereafter while exposed to the ambient atmosphere. A non-oxidizing atmosphere is maintained in the float portion of the process, while the glass is in contact with the molten tin bath, to prevent oxidation. An air atmosphere is maintained in the lehr. The chemical vapor deposition (CVD) of various coatings may be conveniently performed in the bath or the lehr, or even in the transition zone therebetween, by contacting the surface of the hot glass with chemical vapor containing reactants which pyrolytically decompose to form the metal oxide coating. This, of course, requires that the chemical reactants have vaporization temperatures below their thermal decomposition temperatures. Several tin compounds exist which may be vaporized to prepare a tin oxide coating on glass by CVD technology.

Both organic and inorganic tin compounds have been used for the deposition by chemical vapor deposition of fluorine doped tin oxide coatings. Thus, for example U.S. Pat. No. 4,329,379 discloses a process for forming a fluorine doped tin oxide coating on a hot glass substrate by contacting the glass with the vaporized reactants of a tin tetrachloride, hydrofluoric acid (HF), air and water. Similarly, U.S. Pat. No. 4,387,134 teaches that fluorine doped tin oxide films have sheet resistances of 1–10 ohm/square may be produced from a combination of vaporized water, methanol, HF, stannic chloride and H.sub.2/N.sub.2 gases.

A number of techniques are known for forming coatings on a vitreous substrate, including pyrolysis. Pyrolysis generally has the advantage of producing a hard coating, which precludes the need for a protective layer. The coatings formed by pyrolysis have durable abrasive- and corrosion-resistant properties. It is believed that this is due in particular to the fact the process involves depositing of coating material onto a substrate which is hot. Pyrolysis is also generally cheaper than alternative coating processes such as sputtering, particularly in terms of the investment in plant. The deposit of coatings by other processes, for example by sputtering, led to products with very different properties, in particular a lower resistance to abrasion and occasionally a different refractive index.

A wide variety of coating materials have been proposed for glazing panels, and for several different desired properties of the glazing. Tin oxide, $SnO_2$, has been widely used, often in combination with other materials such as other metal oxides. GB Patent 1455148 teaches a method for pyrolytically forming a coating of one or more oxides on a substrate, primarily by spraying compounds of a metal or silicon, so as to modify the light transmission and/or light reflection of the substrate, or to impart antistatic or electrically conductive properties. Its examples of specified oxides include $ZrO_2$, $SnO_2$, $Sb_2O_3$, $TiO_2$, $Co_3O_4$, $Cr_2O_3$, $SiO_2$ and mixtures thereof. Tin oxide ($SnO_2$) is seen as advantageous because of its hardness and its ability to have antistatic or electrically conductive properties. GB Patent 2078213 relates to a sequential spray method for pyrolytically forming a coating on a vitreous support and is particularly concerned with tin oxide or indium oxide as the main coating constituents. When its metal coating precursor is tin chloride this is advantageously doped with a precursor selected from ammonium bifluoride and antimony chloride in order to increase the electrical conductivity of the coating.

It is also known that where a coating of tin oxide is formed by pyrolysis of $SnCl_4$, the presence of a dopant such as antimony chloride $SbCl_5$, directly mixed with the tin chloride $SnCl_4$, improves the absorption and reflection of some near solar infrared radiation.

GB 2200139 describes and claims a method of forming a pyrolytic tin oxide coating on a hot glass substrate by spraying a solution containing a tin compound and additives which produce in the coating both fluorine and such materials as antimony, arsenic, vanadium, cobalt, zinc, cadmium, tungsten, tellurium and manganese so as to give the coating a low emissivity and a low specific internal haze factor. While the resultant coating has many desirable properties it falls short of the combination of properties now being sought.

The following U.S. Patents are hereby incorporated by reference as if set forth in their entirety herein: U.S. Pat. No. 4,900,634, issued to Terneu, et al. on Feb. 13, 1990; U.S. Pat. No. 5,698,262, issued to Soubeyrand, et al. on Dec. 16, 1997; U.S. Pat. No. and 6,231,971, issued to Terneu, et al. on May 15, 2001.

The details in the patents, patent applications and publications may be considered to be incorporable, at Applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A stove for cooking food, said stove comprising:

a stove body;

said stove body comprising a base and a top;

said top comprising a cooktop;

said cooktop comprising a plate having a top and a bottom;

said plate comprising a cutout portion;

a heating arrangement to cook food;

said heating arrangement being disposed at said cutout portion of said plate;

said heating arrangement comprising a device to receive a bottom of a cooking utensil to cook food;

a layer;

said layer being disposed on and attached as a coating to said top of said plate and being disposed substantially adjacent said cutout portion;

at least a portion of said layer, attached as a coating, being disposed at said heating arrangement and being configured to reflect heat produced from at least one of: said heating arrangement and a cooking utensil disposed on said device to receive a bottom of a cooking utensil;

said layer, attached as a coating, comprising at least a portion being disposed, configured, and dimensioned to minimize overheating of said plate at least under said layer, attached as a coating; said layer, attached as a coating, being configured to reflect heat emitted from at least one of: said heating arrangement and an overheated cooking utensil;

said heating arrangement comprising a gas burner;

said cutout portion being disposed about said gas burner;

at least one conduit to supply gas to said gas burner to heat a cooking utensil to cook food; and at least one valve to control the supply of gas to said gas burner of said stove.

2. The stove according to claim 1, wherein:

said cutout portion comprises at least a second cutout portion;

said heating arrangement comprises at least a second heating arrangement for said second cutout portion;

said layer, attached as a coating, comprises a layer at least partially covering said plate at least immediately about said first and second cutout portions;

said layer, attached as a coating, comprises a first layer disposed on said top of said plate; and said stove further comprising:

a second layer disposed between said first layer and said plate;

said second layer comprising a non-glare material to minimize reflection of light.

3. The stove according to claim 2, wherein:

said layer, attached as a coating, comprises a layer substantially fully covering said top of said plate;

said layer, attachd as a coating, comprises a first layer disposed on said top pf said plate; and said stove further comprising:

a second layer disposed between said first layer and said plate;

said second layer comprising a non-glare material to minimize reflection of light.

4. The stove according to claim 1, wherein:

said layer, attached as a coating, comprises a first layer disposed on said top of said plate; and said stove further comprising:

a second layer disposed between said first layer and said plate;

said second layer comprising a non-glare material to minimize reflection of light.

5. A stove for cooking food, said stove comprising:

a stove body;

said stove body comprising a base and a top;

said top comprising a cooktop;

said cooktop comprising a plate having a top and a bottom;

said plate comprising a glass;

said plate comprising at least one cutout portion; said at least one cutout portion comprising a first cutout portion;

at least one gas burner to cook food; said at least one gas burner to cook food comprising a first gas burner to cook food;

said first gas burner being disposed at said first cutout portion of said plate;

said first gas burner comprising a first device configured to receive a bottom of a cooking utensil to cook food;

a layer;

said layer being disposed on said top of said plate and being disposed substantially adjacent said first cutout portion;

at least a portion of said layer being disposed substantially adjacent said first cutout portion being configured to reflect heat produced from at least one of: said first gas burner and a cooking utensil disposed on said first device configured to receive a bottom of a cooking utensil to cook food;

said layer comprising at least a portion being disposed, configured, and dimensioned to minimize overheating of said plate at least under said layer; said layer being configured to reflect heat emitted from at least one of: said first gas burner and an overheated cooking utensil to cook food;

at least one conduit to supply gas to said first gas burner to heat a cooking utensil to cook food; and at least one valve to control the supply of gas to said first gas burner of said stove.

6. The stove according to claim 5, comprising one of (A.) and (B.):

(A.) said at least one cutout portion comprises at least a second cutout portion;

said layer comprises a layer at least partially covering said plate at least immediately about said first and second cutout portions;

said at least one gas burner comprises at least a second gas burner for said second cutout portion;

said layer comprises a first layer disposed on said top of said plate; and said stove further comprising:

a second layer disposed between said first layer and said plate;

said second layer comprising a non-glare material to minimize reflection of light; and (B.) said layer comprises a layer substantially fully covering said top of said plate;

said layer comprises a first layer disposed on said top of said plate; and said stove further comprising:

a second layer disposed between said first layer and said plate;

said second layer comprising a non-glare material to minimize reflection of light.

7. The stove according to claim 6, wherein:

said first layer is disposed in a predetermined pattern;

said pattern having at least one portion that is colored.

8. The stove according to claim 7, wherein:

said plate comprises at least one of: a thermally tempered soda lime glass plate, a chemically tempered soda lime glass plate, a borosilicate glass plate, a non-transparent plastic plate, and a glass ceramic plate.

9. The stove according to claim 5, wherein:

said layer comprises a first layer disposed on said top of said plate; and further comprising:

a second layer disposed between said first layer and said plate;

said second layer comprising a non-glare material to minimize reflection of light.

10. The stove according to claim 7, wherein:

said first layer comprises a layer substantially fully covering said top of said plate.

11. A cooktop for cooking food, said cooktop comprising:

a plate having a top and a bottom;

at least one gas burner to cook food; said at least one gas burner comprising a first gas burner to cook food;

said plate comprising at least one cutout portion; said at least one cutout portion comprising a first cutout portion;

a layer;

said layer being disposed on said top of said plate and being disposed about said first cutout portion;

said first cutout portion of said plate being disposed about said first gas burner;

said first gas burner comprising a first device configured to receive a bottom of a cooking utensil to cook food;

at least a portion of said layer being disposed about said first cutout portion being configured to reflect heat produced from at least one of: said first gas burner and a cooking utensil disposed on said first device configured to receive a bottom of a cooking utensil;

said layer comprising at least a portion being disposed, configured, and dimensioned to minimize overheating of said plate at least under said layer; said layer being configured to reflect heat emitted from at least one of: said first gas burner and an overheated cooking utensil disposed on said first device configured to receive a bottom of a cooking utensil.

12. The cooktop according to claim 11, wherein:

said plate comprises at least one of: a thermally tempered soda lime glass plate, a chemically tempered soda lime glass plate, a borosilicate glass plate, a non-transparent plastic plate, and a glass ceramic plate;

said at least one cutout portion comprises at least a second cutout portion; and said at least one gas burner comprises at least a second gas burner for said second cutout portion.

13. The cooktop according to claim 12, wherein:

said layer comprises a layer at least partially covering said plate at least about said first cutout portion.

14. The cooktop according to claim 13, wherein:

said layer comprises a layer substantially fully covering said top of said plate.

15. The cooktop according to claim 11, wherein:

said layer comprises a layer at least partially covering said plate at least about said first cutout portion;

said layer comprises a first layer disposed on said top of said plate; and said cooktop further comprising:

a second layer adjacent said first layer;

said second layer comprising a non-glare material to minimize reflection of light.

16. The cooktop according to claim 11, wherein:

said layer comprises a layer substantially fully covering said top of said plate;

said layer comprises a first layer disposed on said top of said plate; and said cooktop further comprising:

a second layer adjacent said first layer;

said second layer comprising a non-glare material to minimize reflection of light.

17. The cooktop according to claim 16, wherein:

said second layer comprises a material to minimize diffusion of incident light.

18. The cooktop according to claim 17, wherein:

said first layer is disposed in a predetermined pattern;

said pattern having at least one portion that is pigmented.

19. The cooktop according to claim 18 comprising a hob top; and said first layer being configured to minimize thermal stresses on said plate.

20. The cooktop according to claim 11, wherein:

said layer comprises a first layer disposed on said top of said plate; and said cooktop further comprising:

a second layer adjacent said first layer;

said second layer comprising a non-glare material to minimize reflection of light.

* * * * *

UNITED STATES PATENT AND TRADEMARK OFFICE

CERTIFICATE OF CORRECTION

PATENT NO. : 6,505,621 B2
DATED : January 14, 2003
INVENTOR(S) : Torsten Gabelmann It is certified that error appears in the above-identified patent and that said Letters Patent is hereby corrected as shown below:

Column 1,
Line 42, after “another” delete “.”.
Line 52, after the first occurrence of “the” delete “.”.

Column 2,
Line 14, after “which” delete “-”.

Column 5,
Line 28, after the second occurrence of “is”, delete “subsequent tly” and insert -- subsequently --.

Column 6,
Line 41, before “have”, delete “.263,” and insert -- 263, --.

Column 7,
Line 9, after “separately” delete “.”.
Line 40, after “by” delete “.”.
Line 45, after “protects” delete “.”.

Column 8,
Line 58, after “high”, delete “tem peratures,” and insert -- temperatures, --.

Column 10,
Line 56, after “publication”, delete “nam ely,” and insert -- namely, --.

Column 11,
Line 40, after “for”, delete “cookin gfood” and insert -- cooking food --

Column 15,
Line 43, after “No.”, delete “5,225,6.62,” and insert -- 5,225,662, --.

UNITED STATES PATENT AND TRADEMARK OFFICE

CERTIFICATE OF CORRECTION

PATENT NO. : 6,505,621 B2
DATED : January 14, 2003
INVENTOR(S) : Torsten Gabelmann It is certified that error appears in the above-identified patent and that said Letters Patent is hereby corrected as shown below:

Column 24,
Line 2, after "top", delete "pf" and insert -- of --.

Column 25,
Line 31, after "claim", delete "7," and insert -- 9, --.

Signed and Sealed this

Twenty-sixth Day of August, 2003

JAMES E. ROGAN
*Director of the United States Patent and Trademark Office*